US008649538B2

(12) United States Patent
Apfel et al.

(10) Patent No.: US 8,649,538 B2
(45) Date of Patent: Feb. 11, 2014

(54) HEARING AID HAVING MULTIPLE SOUND INPUTS AND METHODS THEREFOR

(75) Inventors: Russell J. Apfel, Austin, TX (US); David Matthew Landry, Austin, TX (US)

(73) Assignee: Audiotoniq, Inc., Austin, TX (US)

( * ) Notice: Subject to any disclaimer, the term of this patent is extended or adjusted under 35 U.S.C. 154(b) by 195 days.

(21) Appl. No.: 13/023,084

(22) Filed: Feb. 8, 2011

(65) Prior Publication Data

US 2011/0194713 A1 Aug. 11, 2011

Related U.S. Application Data

(60) Provisional application No. 61/303,145, filed on Feb. 10, 2010.

(51) Int. Cl.
*H04R 25/00* (2006.01)

(52) U.S. Cl.
USPC ..... 381/314; 381/312; 381/315

(58) Field of Classification Search
USPC ..... 381/312–318, 320–321
See application file for complete search history.

(56) References Cited

U.S. PATENT DOCUMENTS

| | | | | |
|---|---|---|---|---|
| 5,636,285 | A | 6/1997 | Sauer | |
| 6,236,731 | B1 * | 5/2001 | Brennan et al. | 381/316 |
| 6,748,089 | B1 | 6/2004 | Harris et al. | |
| 7,796,770 | B2 | 9/2010 | Reber et al. | |
| 8,009,848 | B2 * | 8/2011 | Roeck et al. | 381/315 |
| 8,009,849 | B2 * | 8/2011 | Enzmann | 381/315 |
| 8,229,147 | B2 * | 7/2012 | Kindred et al. | 381/315 |
| 8,254,606 | B2 * | 8/2012 | Zhang et al. | 381/315 |

* cited by examiner

*Primary Examiner* — Suhan Ni
(74) *Attorney, Agent, or Firm* — Lee & Hayes, PLLC

(57) ABSTRACT

A multi-mode hearing aid includes a processor that is configured to selectively apply different hearing aid profiles to different input signals, such as a first sound signal received from a microphone and a second sound signal received from a transceiver, to produce first and second shaped output signals. The processor is configured to produce an output signal including at least one of the first shaped output signal and the second shaped output signal.

7 Claims, 5 Drawing Sheets

HEARING AID HAVING MULTIPLE SOUND INPUTS AND METHODS THEREFOR

CROSS-REFERENCE TO RELATED APPLICATION(S)

This application is a non-provisional of and claims priority to U.S. Provisional Patent Application No. 61/303,145 filed on Feb. 10, 2010 and entitled "Hearing Aid Having Multiple Sound Inputs and Methods Therefor," which is incorporated herein by reference in its entirety.

FIELD

The present disclosure relates generally to hearing aids, and more particularly to hearing aids having multiple sound inputs and methods for selectively shaping sounds from the multiple sound inputs.

BACKGROUND

Hearing deficiencies can range from partial hearing impairment to complete hearing loss. Often, an individual's hearing ability varies across the range of audible sound frequencies, and many individuals have hearing impairments with respect to only certain frequencies. For example, an individual's hearing loss may be greater at higher frequencies than at lower frequencies.

Hearing aids have been developed to compensate for hearing losses in individuals. Conventionally, hearing aids detect sound with the use of a microphone, which turns the sound into an analog signal. The analog signal must then be converted into a digital representation, such that it can be processed by a digital signal processor, as configured by an audiologist, to shape the sounds to compensate for the user's hearing deficiencies. However, in some instances, noise from the acoustic environment may interfere with the user's hearing experience.

BRIEF DESCRIPTION OF THE DRAWINGS

In the following description, the use of the same reference numerals in different drawings indicates similar or identical items.

DETAILED DESCRIPTION OF ILLUSTRATIVE EMBODIMENTS

When watching a video or listening to music, decoded audio data is replayed through a speaker associated with a media player (such as a television, a stereo, MP3, or other electronic device) to provide a sound experience for the user. Conventionally, a microphone of a hearing aid receives the sounds from the media player and converts them into electrical signals, which can be modulated and amplified for reproduction by a speaker at or within the user's ear. However, the microphone may receive the sounds from the media player as well as background noise, which can interfere with the user's listening experience.

Embodiments of systems are described below that utilize a wireless, radio frequency communication channel to communicate audio data directly to a hearing aid. In this manner, the sound data can be delivered directly to the hearing aid and reproduced for the user without any noise distortion due to environmental sounds. In some instances, environmental sounds converted into electrical signals by the microphone of the hearing aid can be used to synchronize the timing of the sound data. Additionally, the sound data can be used to adaptively filter sounds received by the microphone, for example, to remove the sounds from the speaker of the media player. In one instance, a processor of the hearing aid provides a selected one of the sound data and the environmental sound data to the speaker of the hearing aid. In another instance, the processor combines the sound data and a filtered version of the environmental sound data to produce a composite sound signal that is reproduced by the speaker of the hearing aid.

Figure 1:
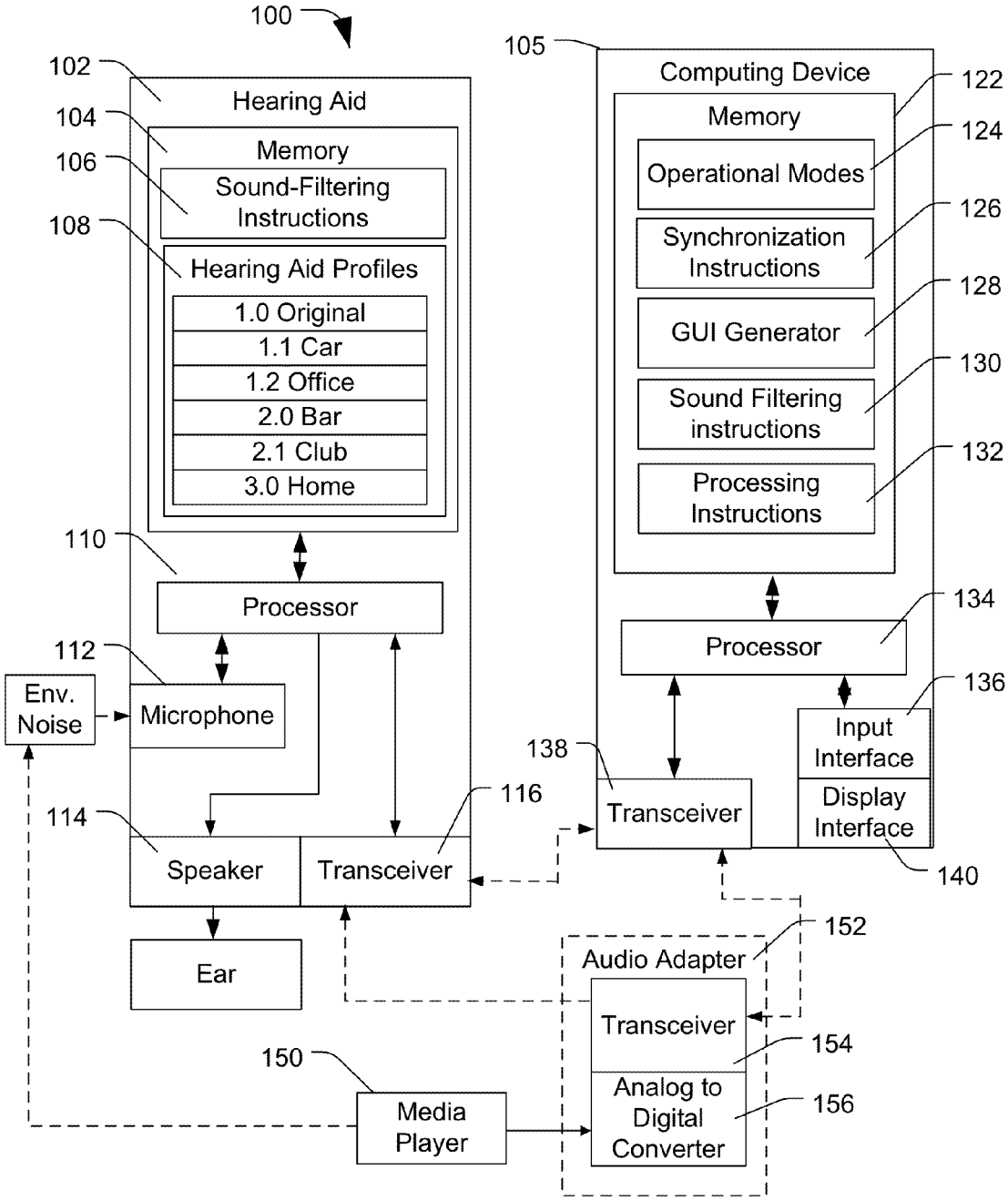
FIG. 1 is a block diagram view of an embodiment of a system including a hearing aid, a computing device, and a media player.

FIG. 1 is a block diagram of a system 100 including a hearing aid 102, a computing device 105, and a media player 150. Media player 150 may be a television (as shown), set-top box (such as a cable or satellite television decoder box) that can be coupled to a television, stereo receiver, a Moving Picture Experts Group (MPEG)-1 or MPEG 2 Audio Layer 3 (commonly referred to as "MP3") player, a mobile phone (cellular or digital phone), a digital video disc (DVD) player, a video cassette recorder (VCR), a digital video recorder (DVR), or other media-playing device configured to reproduce media content in an audible and/or visible form. In some instances, such media players may be coupled to other electronic devices, such as speakers, displays, or any combination thereof, to reproduce decoded audio information and/or video information.

Media player 150 may include or may be coupled to an audio adapter 152 including an analog-to-digital converter (ADC) 156 and a transceiver 154. ADC 156 converts an analog audio signal into a digital signal, which is communicated by transceiver 154 to hearing aid 102 through a communication channel. In an alternative embodiment, media player 150 may transmit digital signals to audio adapter 152, in which case the digital signals may bypass ADC 156 for communication via transceiver 154. The communication channel may include one or more wires or may be a wireless (radio frequency) communication channel. In a particular embodiment, transceiver 154 is a Bluetooth® transceiver, which can communicate audio data to a second Bluetooth® receiver, such as transceiver 116, within hearing aid 102. In another embodiment, transceiver 154 is configured to connect to a plug or connector or jack that is and is adapted to receive data from media player 150 through a wired connection. In this instance, the plug or connector (jack) can be adapted to accept a wired connection such as a USB (universal serial bus) connector, a mini stereo plug, a TRS (tip, ring, sleeve) connector, an RCA connector (phono connector or cinch connector), or another commonly used connector.

Hearing aid 102 includes a microphone 112 to convert environmental sounds into electrical signals. In this instance, microphone 112 is a circuit that includes an ADC (not shown) to convert the electrical signals into digital signals. Hearing aid 102 further includes a processor 110 connected to microphone 112, which provides the digital signals to processor 110 as a first input signal. Processor 110 is connected to memory 104, to speaker 114, and to transceiver 116. Speaker 114 converts electrical signals into audible sounds, which are reproduced at or within the user's ear. Transceiver 116 is configured to communicate with transceiver 154 through the communication channel. In some instances, transceiver 116 may also communicate with a transceiver 138 of computing device 105.

Memory 104 stores sound-filtering instructions 106, which are executable by processor 110. Memory 104 also stores hearing aid profiles 108, which can be applied independently or in conjunction with the sound-filtering instructions 106 to shape the first input signal to produce a first shaped output signal. As used herein, the term "hearing aid profile" refers to a collection of acoustic configuration settings for hearing aid 102, which are used by processor 110 to shape electrical signals related to sounds to compensate for the user's hearing loss. In one embodiment, sound-filtering instructions 106 represent a set of equations, coefficients for shaping the equations, algorithms, other instructions, or any combination thereof that, when applied by processor 110, causes processor 110 to shape the audio output of speaker 114 to produce sounds that compensate for the user's hearing deficiency.

System 100 further includes computing device 105, which is configured to communicate with hearing aid 102 and optionally with audio adapter 152 through wired or wireless communication channels. Computing device 105 can be a personal digital assistant (PDA), a smart phone, a portable computer, or another computing device. One representative example of computing device 105 includes the Apple iPhone®, which is available from Apple, Inc. of Cupertino, Calif. or the Blackberry®, available from Research In Motion Limited of Waterloo, Ontario Canada. Other types of mobile telephone devices or portable computing devices with short range wireless communication capability can also be used.

Computing device 105 includes a memory 122, which is connected to a processor 134. Processor 134 is connected to a transceiver 138 and to a user interface, which includes a display interface 140 for displaying information and an input interface 136 for receiving user input. Input interface 136 can be a keypad, a keyboard, a mouse, a stylus, a touch-sensitive interface (such as a track pad or touch-sensitive surface), or any combination thereof, that is configured to receive input from the user. In some embodiments, a touch screen display may be used, in which case, display interface 140 and input interface 136 may be combined to display information and to receive user input responsive to the displayed information.

Memory 122 stores a plurality of instructions that are executable by processor 134, including graphical user interface (GUI) generator instructions 128, synchronization instructions 126, processing instructions 132, and one or more sound-filtering instructions 130. Memory 122 also stores one or more instructions relating to operational modes 124. Such modes may include a media player mode, a normal listening mode, and other modes.

In an embodiment, computing device 105 can be used to adjust hearing aid 102 during normal operation, such as when a user is watching television, listening to a stereo, having a conversation with another person, and so on. In an example, processor 134 executes GUI generator 128 to produce a graphical user interface with which a user may interact to select a television operating mode from operational modes 124. In response to the user selection, processor 134 transmits a mode selection signal to hearing aid 102 via transceiver 138.

In response to receiving the mode selection signal, transceiver 116 provides the signal to processor 110. Processor 110 may, in response to the mode selection signal, control transceiver 116 to receive audio information from transceiver 154 of audio adapter 152. In this example, processor 110 receives a first signal from microphone 110 and a second signal from transceiver 116.

In one example, processor 110 executes sound filtering instructions 106 to filter audio output from media player 150 received by microphone 112 and to amplify a portion of the first signal from microphone 112 that is not also included in the data related to the second signal from transceiver 116. In a second example, filtering instructions 106 may amplify the data related to the second signal from transceiver 116 while muting the data received from microphone 112. Once processor 110 has completed the filtering process, processor 110 applies a hearing aid profile 108 to shape the sound for the individual user.

In one embodiment, processor 110 combines sound information from microphone 112 with audio data from transceiver 116 to produce a composite audio signal, which is shaped using a selected one of hearing aid profiles 108 to produce a shaped output signal that is provided to speaker 114 for reproduction at or within the ear of the user. In another embodiment, processor 110 suppresses sound information from microphone 112 while providing sound information from transceiver 116 to processor for producing the shaped output signal. In still another embodiment, processor 110 applies a first hearing aid profile to sound information received from microphone 112 and a second hearing aid profile to sound information received from transceiver 116. In an embodiment, processor 110 is configured to synchronize environmental signal content from the first input signal with content of the second input signal. In particular, sounds received from media player 150 through transceiver 116 and corresponding sounds output from a speaker of media player 150 and received via microphone 112 can be synchronized. In an embodiment, the corresponding sounds are synchronized in order to adaptively filter the first input signal to remove audio content associated with the media player 150 prior to applying the hearing aid profile to shape the combined signals. In this instance, processor 110 may combine the filtered and shaped first output signal with the second shaped output signal to produce a combined output signal that is provided to speaker 114 for playback to the user. By reproducing the second input signal received directly from media player 150 rather than a captured version of that signal from microphone 112, hearing aid 102 produces a better quality audio signal having reduced echo effects, reduced environmental noise, reduced reverberation effects, and reduced overall corruption of the sound signal, as compared to the sounds captured by the microphone 112. Thus, the overall quality of the hearing experience of the hearing aid user is improved, especially in indoor environments. Further, by combining a portion of the signal from microphone 112 with the second input signal, environmental sounds that are unrelated to the media player 150 are still provided to the user, allowing the user to participate in conversations, to hear the doorbell, or to otherwise enjoy a social experience.

In an example, processor 134 executes the graphical user interface (GUI) generator instructions 128 to produce a graphical user interface for display on display interface 140 and to receive user input from input interface 136 corresponding to user-selectable elements of the graphical user interface. The graphical user interface can include one or more user selectable elements (such as menus, check boxes, buttons, radio buttons, clickable links, selectable images, and so on). A user may interact with user interface 136 to provide input corresponding to the user-selectable elements in order to configure hearing aid 102. In one example, the user may interact with the graphical user interface to select one of the operating modes 124 of the hearing aid 102. In this instance, hearing aid 102 may have multiple operating modes. One operating mode can include a "media player mode" where processor 110 provides only media content received by transceiver 116 from media player 150 to the speaker 114 and ignores or filters out environmental sounds from microphone 112. Another operating mode can include an "environmental mode", where processor 110 provides only environmental sounds from microphone 112 to the speaker 114, while sound data received by transceiver 116 from media player 150 through the communication channel is ignored. Still another operating mode includes a "mixed operating mode" where processor 110 combines environmental sounds from microphone 112 and sound data received by transceiver 116 from media player 150 to produce a combined output, which is provided to the speaker 114. In yet another operating mode, processor 110 adaptively filters the environmental sounds from microphone 112 to remove sound information associated with an audible output provided by media player 150 and replaces the sound information with sound data received by transceiver 116 from media player 150 through the communication channel. Other operating modes may also be used.

In a second example, the user may select one or more options from the graphical user interface by interacting with input interface 136 to select sound-filtering instructions or settings 130 for configuring hearing aid 102. In this instance, the graphical user interface presents user-selectable options or configurable elements for configuring particular filtering settings applied of hearing aid 102. In an example, the user may interact with the graphical user interface through input interface 136 to adjust one or more settings of a hearing aid profile.

Additionally, GUI generator instructions 128 may be executed by processor 134 to produce a graphical user interface through which the user can control the operation of media player 150, such as by sending data packets through the communication channel to media player 150 through audio adapter 152 or through a second communication channel, such as an infrared communication channel (similar to a remote control device). For example, the user may interact with the graphical user interface displayed on display interface 140 of computing device 105 by interacting with input interface 136 to adjust volume, balance, tone, or other audio settings of media player 150. Further, computing device 105 may be used to control a tuner within media player 150 to select a particular station (or channel) or to select a media source from which the media content is being played. In an example, a user may interact with computing device 105 to change a channel frequency or an input source, or to switch between CDs or DVDs in a multi-disc system. In the illustrated embodiment where media player 150 is a television, the user interface may also control visual settings, channel settings, contrast, and other menu options of media player 150.

In operation, a user may configure hearing aid 102 to receive media content through the communication channel from audio adapter 152 instead of through microphone 112.

In some instances, a television set, such as media player 150, may utilize an adapter, such as a set-to-box (STB) device to decode an input signal, such as a cable or satellite broadcast signal, which can be replayed through the media player 150. In such a case, the transceiver or transmitter that broadcasts the audio data to hearing aid 102 may be incorporated in the STB device, as shown in FIG. 2.

Figure 2:
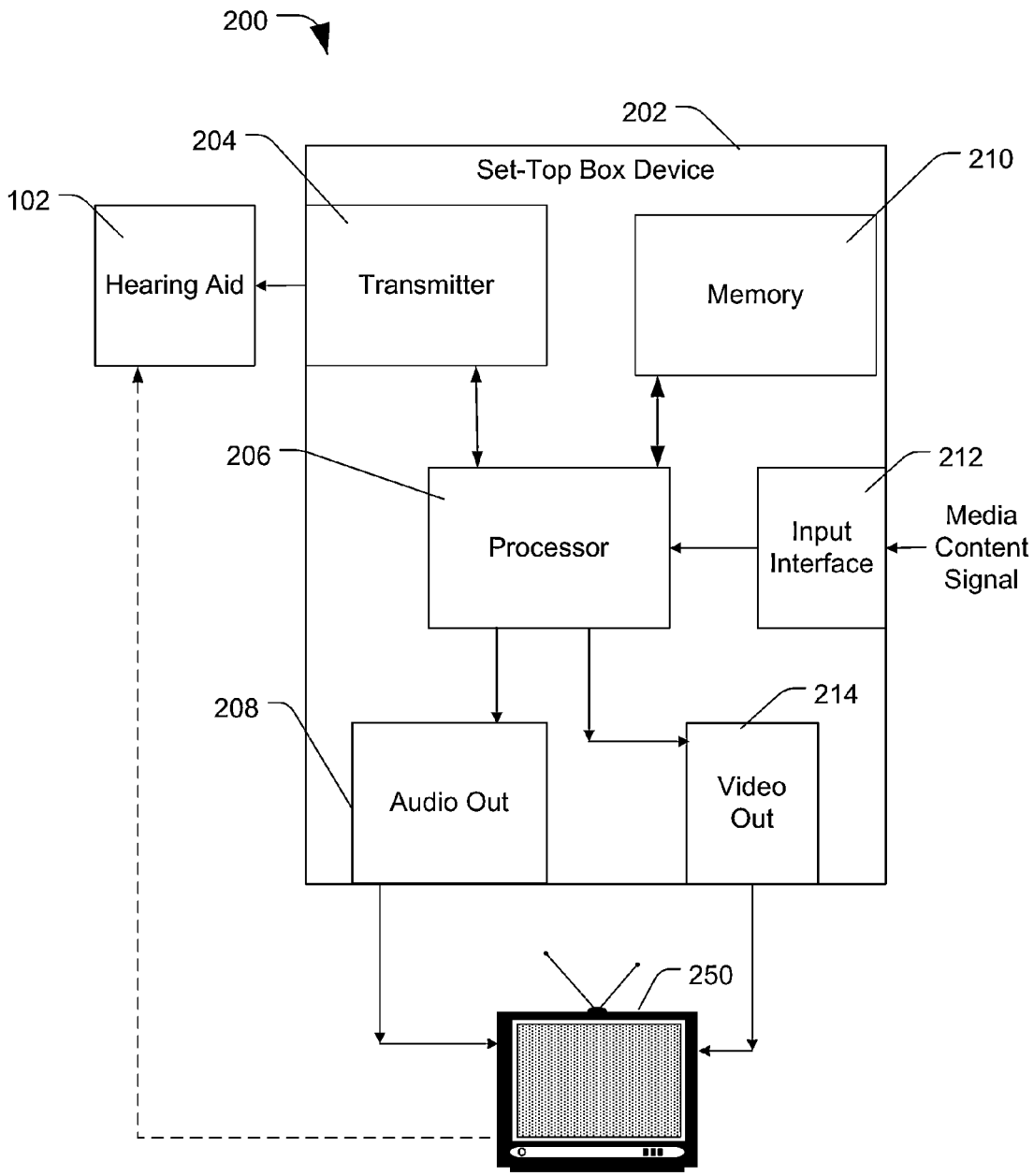
FIG. 2 is a block diagram view of an embodiment of a set-top box compatible with the hearing aid of FIG. 1.

FIG. 2 is a block diagram of an embodiment of a system 200 including hearing aid 102, television 250, and a set top box (STB) device 202, which is configurable to communicate with hearing aid 102. Set top box 202 includes an input interface 212 that can be coupled to coaxial cable or other cable to receive encoded media content, such as audio data, video data, or any combination thereof, from a media source, such as a cable television provider, a satellite television provider, a satellite radio provider, or other media source (such as a computer server configured to provide media content over the Internet).

STB device 202 includes a processor 206 coupled to the input interface 212 to receive encoded media content, including video content and/or audio content. Processor 206 may access instructions stored in memory 210 to decode the encoded media content. Processor 206 provides decoded audio data to an audio output 208, and provides decoded video data to a video output 214. Additionally, processor 206 is connected to a transmitter 204 to provide audio data to hearing aid 102 through a communication channel. In an alternative embodiment, processor 206 may be replaced by an audio decoder and video decoder.

In operation, set-top box device 202 receives a media content signal from a content source at input interface 212 and provides the media content signal to processor 206. Processor 206 decodes the media content signal into an audio signal and a video signal, which are provided to audio output 208 and video output 214, respectively. Further, processor 206 provides the audio data to transmitter 204, which is configured to format and transmit the audio data to hearing aid 102 though the communication channel.

By transmitting the audio data directly to hearing aid 102, any distortion produced by a speaker of television 250 is bypassed, providing better sound quality. Further, the set-top box device 202 can provide audio data from the media content signal that is free from environmental noise. As discussed above with respect to FIG. 1, hearing aid 102 is configurable to selectively provide the audio data received from STB device 202, audio information from the environment, or some combination thereof to the user through speaker 114 within hearing aid 102, depending on the selected operating mode.

In some instances, the television 250 may be coupled to a stereo receiver to provide surround sound or audio playback functionality. In such instances, the stereo receiver device may include a transceiver configured to communicate audio data to hearing aid 102 through a communication channel as discussed below with respect to FIG. 3.

Figure 3:
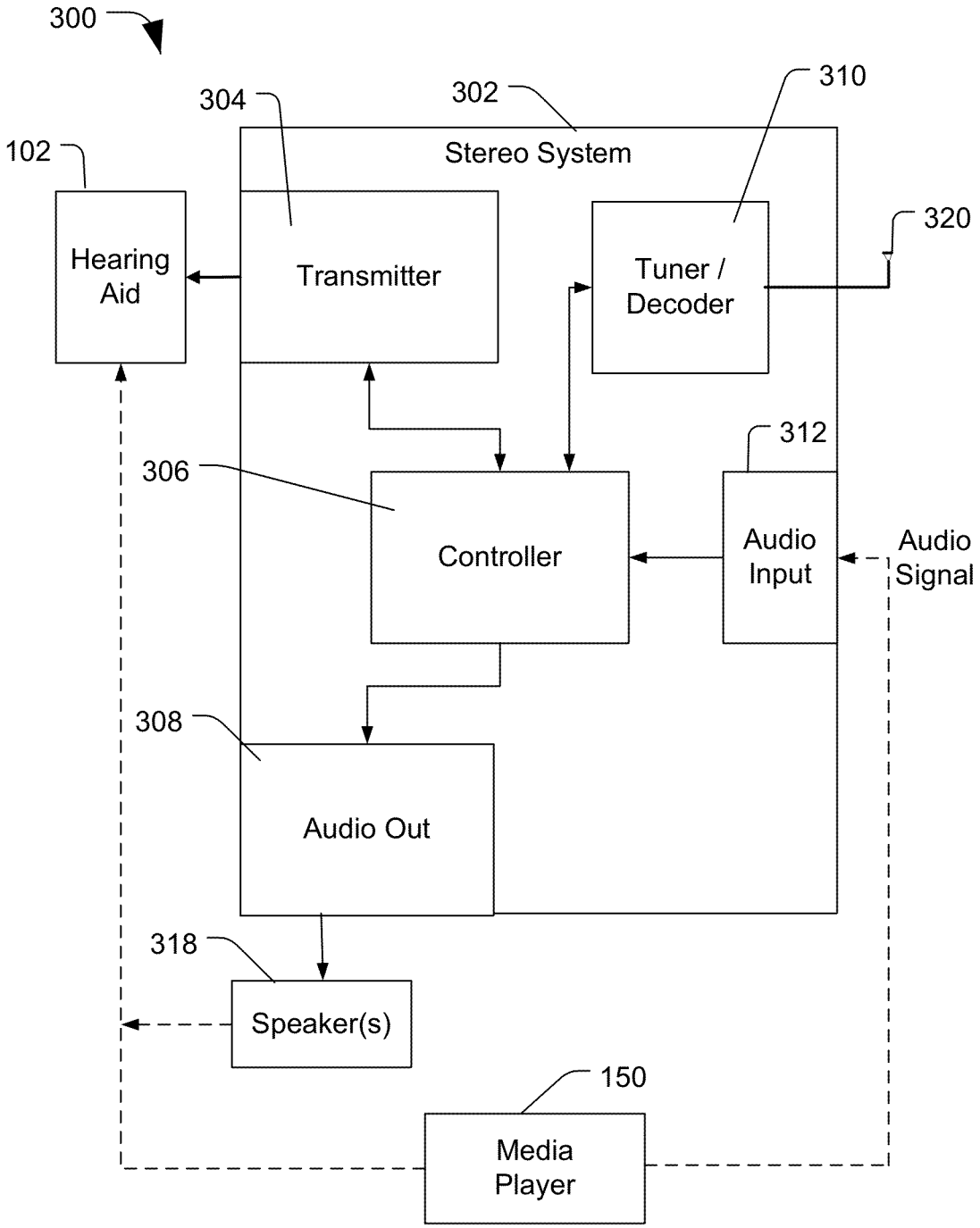
FIG. 3 is a block diagram of an embodiment of a stereo receiver system compatible with the hearing aid of FIG. 1.

FIG. 3 is a block diagram of an embodiment of a system 300 including hearing aid 102 configured to receive audio information from at least one of a speaker of a media player 150, such as a television, a speaker associated with a stereo system 302, and a transceiver of stereo system 302. Stereo system 302 includes an audio input interface 312 to receive an audio signal, such as an audio output signal from a set-top box (STB) device, from a media player, such as a VCR player, a CD player, a DVD player, an MP3 player, or from some other type of media player device. Stereo system 302 further includes a tuner 310, which is connected to antenna 320 to receive radio frequency signals, such as AM radio signals, FM radio signals, or satellite radio signals. Tuner 310 is configured to tune to a desired frequency to extract audio content from a broadcast signal received via antenna 320. Audio input from audio interface 312 or from tuner 310 is provided to controller 306.

Controller 306 may be an audio decoder, a gain amplifier, an audio mixer, another type of filter, or a combination thereof. In some instances, controller 306 is a digital signal processor configurable to process signals. Controller 306 is configured to provide an audio output signal to one or more speakers 318 through audio output 308. Further, controller 306 is configured to provide the audio output signal to transmitter 304 for transmission to hearing aid 102 through the communication channel.

In an example, stereo system 302 provides decoded audio data directly to hearing aid 102 in addition to reproducing the audio information through speaker 318. Further, media player 150 may produce an audible output based on the same audio information. In this instance, hearing aid 102 receives the audio information from the communications channel via transceiver 116 and receives sounds from media player 150 and speaker 318 through microphone 112. Depending on the operating mode of hearing aid 102, hearing aid 102 may provide only the transmitted audio data to speaker 114 within hearing aid 102 for reproduction for the user. Alternatively, in a different operating mode, the various signals may be combined and synchronized within hearing aid 102 to provide a composite sound signal that is shaped to compensate for the user's hearing deficiency.

Figure 4:
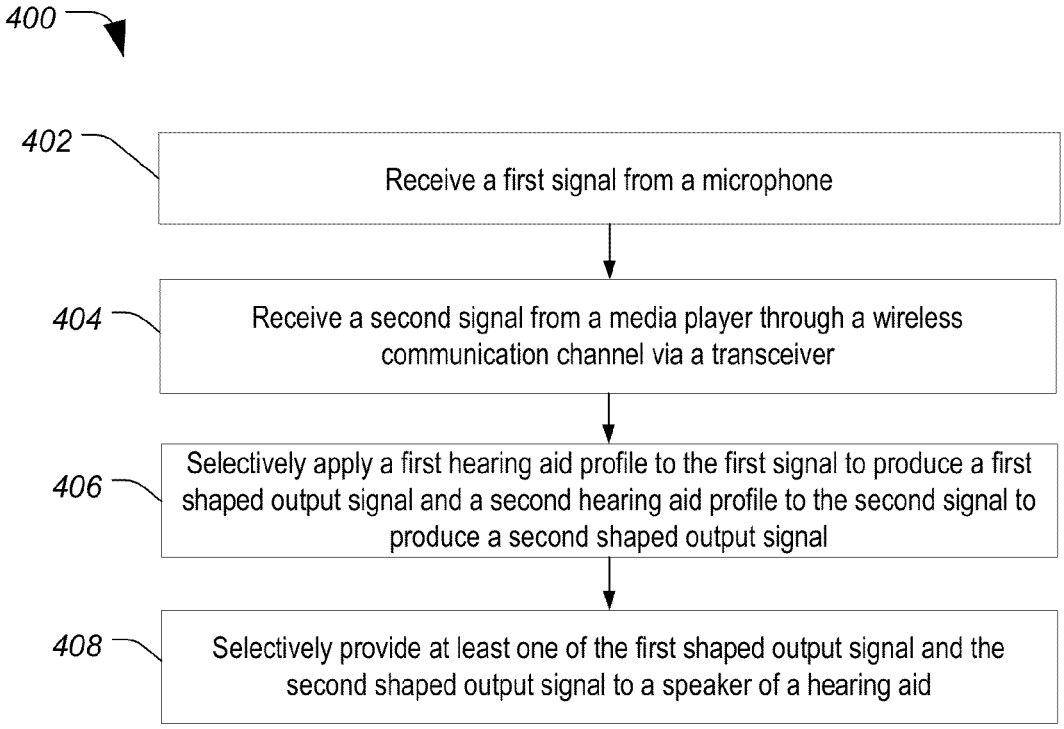
FIG. 4 is a flow diagram of an embodiment of a method of selectively providing input signals to the user.

FIG. 4 is a flow diagram of an embodiment of a method 400 of selectively providing input signals to speaker 114. At 402, processor 110 receives a first signal from a microphone, such as microphone 112. As previously discussed, microphone 112 converts sounds into electrical signals, which are provided as the first signal to processor 110. Proceeding to 404, processor 110 receives a second signal from a media player through a communication channel via transceiver 116. The second signal can be received from a media player, a stereo receiver, a STB device, or an adapter coupled to any of the aforementioned devices.

Advancing to 406, processor 110 selectively applies a first hearing aid profile to the first signal to produce a first shaped output signal and applies a second hearing aid profile to the second signal to produce a second shaped output signal. In an example, the first signal includes environmental noise that is not present in the second signal, so the second hearing aid profile may include less filtering than the first hearing aid profile. In some instances, hearing aid 102 operates in a media player mode, and processor 110 ignores the first signal. In this mode, hearing aid 102 may shape the second signal according to the second hearing aid profile. In another operating mode, hearing aid 102 may ignore the second signal and shape the first signal according to the first hearing aid profile. In still another operating mode, the hearing aid 102 may apply the same hearing aid profile to both signals to produce shaped output signals, which can be combined to produce a modulated output signal.

Continuing to 408, processor 110 selectively provides at least one of the first shaped signal and the second shaped signal to speaker 114 of the hearing aid 102 for playback to the user. In one embodiment, processor 110 may provide only the first shaped output signal to speaker 114 or only the second shaped output signal to speaker 114. In a second embodiment, processor 110 may adaptively filter the first signal based on the second signal to produce a filtered version of the first signal. For example, processor 110 may filter the data related to the second signal from the first signal to produce a filtered first signal that does not include data related to the second signal. Processor 110 may then shape both the filtered first signal and the second signal to produce a first shaped signal and a second shaped signal.

Figure 5:
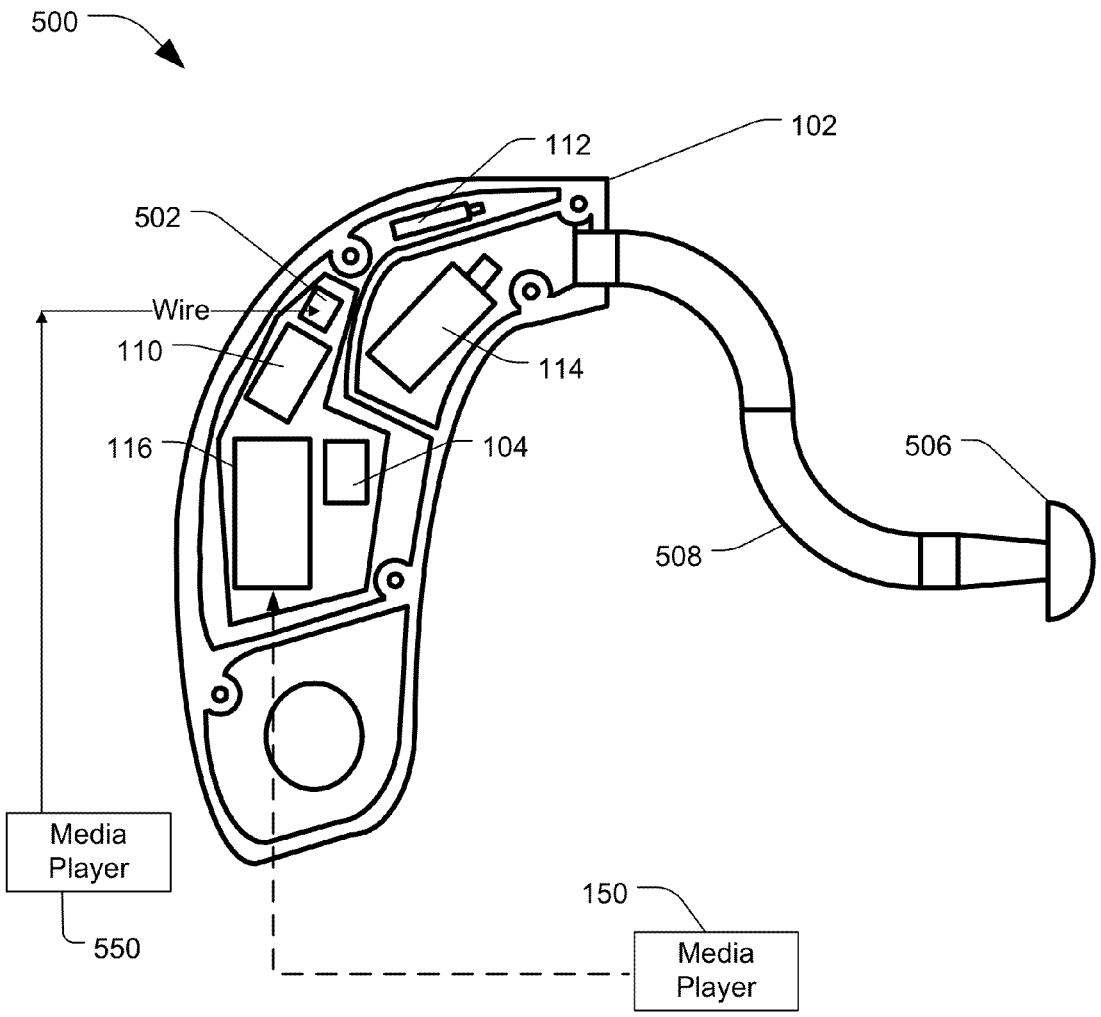
FIG. 5 is a cross-sectional view of a system including a hearing aid having multiple inputs adapted to receive sound information from multiple sources.

FIG. 5 is a cross-sectional view of an embodiment of a system 500 including hearing aid 102 having multiple inputs adapted to receive sound information from multiple sources. Hearing aid 102 includes a connector or receptacle 502 for receiving a wired connector from a media player 550. Hearing aid 102 further includes a transceiver 116 for receiving wireless communication from media player 150. In this illustrated example, speaker 114 is depicted within the housing of hearing aid 102; however, in alternative embodiments, speaker 114 may be positioned within an ear bud 506, which is connected to the housing of hearing aid 102 through ear tube 508.

In an example, processor 110 is coupled to the connector or receptacle 502, which is configured to accept a connector that is coupled to media player 550. Processor 110 receives audio data from media player 550 though connector or receptacle 502. Processor 110 may also receive audio data from microphone 112 and from transceiver 116. Processor 110 can apply a first hearing aid profile to audio signals from media player 550, a second hearing aid profile to audio signals from media player 150, and a third hearing aid profile to audio signals from microphone 112 to produce first, second, and third shaped audio signals, respectively. Any combination of the first, second, and third shaped audio signals may be provided to speaker 114 for producing an audible signal that is compensated for the user's hearing deficiency. Processor 110 selectively provides at least one of the first shaped output signal, the second shaped output signal, and the third shaped output signal to speaker 114 to produce an audible signal at or within the user's ear canal.

In an embodiment, processor 110 may apply the same hearing aid profile to all three signals, one profile to the first sound signal and a second hearing aid profile to both the second and third sound signal, or apply a different hearing aid profile to each of the sound signals. In the alternative, processor 110 may be configured to synchronize signal content from either or both of the input signals from connector or receptacle 502 and from transceiver 116 to signal content from microphone 112 to adaptively filter the input signal content received by microphone 112 to remove audio content associated with audio content provided by media players 150 and/or 550 prior to applying the hearing aid profile to shape the signal.

In this instance, processor 110 may combine the filtered and shaped output signals to produce a combined output signal that is provided to speaker 114 for playback to the user. By reproducing the input signals received directly from media players 150 and 550 rather than a captured version of that signal from microphone 112, hearing aid 102 produces a better quality audio signal having reduced echo effects, reduced environmental noise, reduced reverberation effects, and reduced overall corruption of the sound signal, as compared to the sounds captured by the microphone. Thus, the overall quality of the hearing experience of the hearing aid user is improved, especially in indoor environments. Further, by combining a portion of the signal from microphone 112 with the input signal from either media player 150 or media player 550 (or both), environmental sounds that are unrelated to the media players 150 and 550 are still provided to the user, allowing the user to participate in conversations, to hear the doorbell, or to otherwise enjoy a social experience.

In conjunction with the systems and methods described above with respect to FIGS. 1-5 a multi-mode hearing aid system comprising a hearing aid and a media player is disclosed. The hearing aid includes a microphone to convert environmental sound into a first input signal and a transceiver configured to receive a second input signal from a media player through a communication channel. In some instances, the hearing aid may include an input for receiving audio signals from a wired connection. A processor is configured to selectively provide data related to at least one of the signals to a speaker based on a selected operating mode. In a particular embodiment, the processor is configured to apply a first hearing aid profile to one of the input signals and a second hearing aid profile to the other of the input signals.

Although the present invention has been described with reference to preferred embodiments, workers skilled in the art will recognize that changes may be made in form and detail without departing from the scope of the invention.

What is claimed is:

1. A muiti-mode hearing aid, the hearing aid comprising:

at least one microphone to convert sounds into a first signal;

a transceiver to receive a second signal through a communication channel; and a processor adapted to apply a first hearing aid profile to the first signal to produce a first shaped output signal and a second hearing aid profile to the second signal to produce a second shaped output signal; and a speaker coupled to the processor and adapted to produce an audible sound based on the first output signal if the multi-mode hearing aid is in a first mode, based on the second output signal if the multi-mode hearing aid is in a second mode and based on both the first output signal and the second output signal if the hearing aid is in a third mode.

2. The multi-mode hearing aid of claim 1, wherein the second signal comprises sound data received from a media player.

3. The multi-mode hearing aid of claim 2, wherein the media player is at least one of a television, radio, stereo speaker system, set-top box, and computer.

4. The multi-mode hearing aid of claim 1, further comprising:

an input port coupled to the processor and configurable to receive a connector of a wire to couple the processor to a media player to receive a third signal; and wherein the processor adapted to apply a third hearing aid profile to the third signal to produce a third shaped output signal.

5. The multi-mode hearing aid of claim 1, wherein the processor is configured to filter audio content of the second signal from the audio content of the first signal to produce a filtered signal and apply a selected one of the first hearing aid profile and the second hearing aid profile to the filtered signal to produce a shaped output signal.

6. The multi-mode hearing aid of claim 1, wherein the processor is configured to:

synchronize and combine the first signal with the second signal to produce a combined signal and apply a selected one of the first hearing aid profile and the second hearing aid profile to the combined signal to produce a shaped output signal.

7. The multi-mode hearing aid of claim 1, wherein the processor is configured to:

synchronizes and combines the first output signal with the second output signal to produce a shaped output signal.

* * * * *